US005539428A

United States Patent [19]

Bril et al.

[11] Patent Number: 5,539,428

[45] Date of Patent: Jul. 23, 1996

[54] VIDEO FONT CACHE

[75] Inventors: Vlad Bril, Campbell; Rakesh K. Bindlish, San Jose, both of Calif.

[73] Assignee: Cirrus Logic, Inc., Fremont, Calif.

[21] Appl. No.: 176,563

[22] Filed: Dec. 30, 1993

[51] Int. Cl.[6] ..... G09G 5/22

[52] U.S. Cl. ..... 345/143; 345/193; 345/195; 395/150

[58] Field of Search ..... 345/23, 25, 26, 345/132, 141–144, 192–195, 201, 203; 382/198, 200; 395/110, 115, 116, 150, 151, 164, 166, 434, 460, 493; 364/DIG. 1

[56] References Cited

U.S. PATENT DOCUMENTS

| | | | |
|---|---|---|---|
| 4,345,244 | 8/1982 | Greer | 345/192 |
| 4,486,856 | 12/1984 | Heckel et al. | 345/193 |
| 4,587,629 | 5/1986 | Dill | 395/493 |
| 4,847,758 | 7/1989 | Olson | 395/460 |
| 4,868,554 | 9/1989 | Aoki | 345/193 |
| 4,937,565 | 1/1990 | Suwannukul | 345/195 |
| 5,043,712 | 8/1991 | Kihara | 345/195 |
| 5,159,676 | 10/1992 | Wicklund | 395/434 |
| 5,208,908 | 5/1993 | Harrison et al. | 395/150 |
| 5,243,703 | 9/1993 | Farmwald | 364/DIG. 1 |
| 5,265,236 | 11/1993 | Mehring | 364/DIG. 1 |

OTHER PUBLICATIONS

"True Color VGA Family—CL–GD542X" Technical Reference Manual, Jan. 1994, Cirrus Logic.

"Programmer's Guide to the EGA and VGA Cards," 2nd Edition, Richard Ferraro, 1990.

Tandy, "TRS–80 Color Computer Technical Reference Manual" Ft. Worth, 1981. pp. 21–27.

*Primary Examiner*—Steven Saras

*Attorney, Agent, or Firm*—Robert Platt Bell & Associates

[57] ABSTRACT

A video controller receives character data, attribute data and font data, each of which are stored in different planes of a video memory. The font data comprises bit maps of at least two character fonts, which may be user fonts or default fonts loaded from a controller BIOS. The video controller retrieves the font data, translates the font data into a page mode, and stores the font data in a hidden font cache in an unused portion of the video memory. The paged font data is divided into a number of pages equal to the number of scan lines per character. Each page contains a number of words, and each word contains at least two bytes. Each byte represents one scan line of a character in a different font. The video controller retrieves the paged fonts in page mode and assembles the scan lines for the characters to be displayed into one video scan line. The use of the page mode increases refresh rate and allows simultaneous display of two fonts.

21 Claims, 5 Drawing Sheets

Font-Cache Memory Map

| | | |
|---|---|---|
| 3BFFF | Prim-Font, ASCII=FF,SCLN=1F | Sec-Font, ASCII=FF,SCLN=1F |
| 3BFFE | Prim-Font, ASCII=FESCLN=1F | Sec-Font, ASCII=FE,SCLN=1F |
| 3BFFD | Prim-Font, ASCII=FD,SCLN=1F | Sec-Font, ASCII=FD,SCLN=1F |
| | ⋮ | ⋮ |
| 3A101 | Prim-Font, ASCII=0,SCLN=1 | Sec-Font, ASCII=0,SCLN=1 |
| 3A100 | Prim-Font, ASCII=FF,SCLN=0 | Sec-Font, ASCII=FF,SCLN=0 |
| | ⋮ | ⋮ |
| 3A002 | Prim-Font, ASCII=2,SCLN=0 | Sec-Font, ASCII=2,SCLN=0 |
| 3A001 | Prim-Font, ASCII=1,SCLN=0 | Sec-Font, ASCII=1,SCLN=0 |
| 3A000 | Prim-Font, ASCII=0,SCLN=0 | Sec-Font, ASCII=0,SCLN=0 |

Figure 4

VIDEO FONT CACHE

TECHNICAL FIELD

The present invention relates to a video font cache and operating method for use in a video controller integrated circuit.

BACKGROUND ART

Video controller integrated circuits are known in the art for controlling video displays such as CRTs and flat panel displays. Such video controller ICs are typically incorporated into video controllers (e.g., MDA, CGA, EGA, VGA or the like) for use in computer systems (e.g., IBM™ PC or the like). Such video controllers also incorporate a video memory (VMEM) for storing video information for forming a video display.

FIG. 3 shows an example of a prior art video controller IC which is presented here for purposes of illustration only. The present invention may also be applied to other types of video controller ICs without departing from the spirit or scope of the invention.

Referring to FIG. 3 there is shown an internal block diagram of a video controller IC 101. System data written to the integrated circuit via system data bus 105, system control bus 106, and system address bus 108 (hereinafter generally referred to as system busses 105, 106, 108) go through CPU interface 120 to control the other elements of video controller IC 101 via an internal data and control bus 125. Status and other data can also be read from the other elements in video controller IC 101 via internal data and control bus 125, CPU interface 120 and system busses 105, 106, 108.

Data written to video controller IC 101, which are intended to be stored in an external video memory (not shown), are written through and modified as necessary by graphics controller 117, then written to memory controller 116. Memory controller 116 drives appropriate values on video memory control bus 109 and video memory address bus 110, and drives data out on video memory data bus 111.

Memory controller 116 is also responsible for reading memory data which is needed to define video data. Memory controller 116 drives appropriate values on video memory control bus 109 and video memory address bus 110, and receives video memory data on video memory data bus 111. Video data is stored in an external video memory (not shown) coupled to video memory busses 109, 110 and 111.

In operation, video data from memory controller 116 passes through video FIFO 118, then is modified as necessary in attribute controller 121 before being output on video output data bus 104. Data on video output data bus is further modified by video output block 123, and driven out on video output 103. Video output block 123 may comprise, for example, a RAMDAC (Random Access Memory Digital to Analog Converter). Video signals entering the RAMDAC may comprise, for example, data which describe a color to be displayed. This data may define a number representative of a particular color, but not necessarily the color itself. The RAM portion of the RAMDAC contains a lookup table which converts this number into a digital signal representing a color value. The contents of the lookup table can be altered by software such that a particular color value can be assigned to a different number (or vice versa). The DAC portion of the RAMDAC converts this color value to an analog output, for example, analog VGA or the like, which is then transmitted on video output 103.

CRT controller 119 generates the signals of video output control bus 102. Memory controller 116 uses one of internal clocks 126. CRT controller 119, video FIFO 118, attribute controller 121, and video output 123 use a different, asynchronous one of internal clocks 126. Techniques known in the art are used to synchronize the transfer of data from memory controller 116 to video FIFO 118. In normal operation, internal clocks 126 are generated by clock synthesizer 122, which may use system reference clock 107.

Signature generator 124 can be used for testing in either the test environment or in normal operation. Signature generator 124 takes as its inputs video output control bus 102, video output data bus 104, control information over internal data and control bus 125 from CPU interface 120, and the same asynchronous one of internal clocks 126 which was used by CRT controller 119, video FIFO 118, attribute controller 121, and video output 123.

Video controllers typically use one of two modes to display information on a video display. A graphics mode may be used to display graphics information (e.g., drawings, pictures, or the like) from information typically stored as a bit map in the video memory. Such graphics information is typically stored in the video memory, arranged into four bit planes. An alphanumeric (or text) mode is also provided to display text only (or primitive graphics produced from text-like characters). Although alphanumeric modes are not as versatile as graphics modes, they are generally faster in terms of screen refresh rates.

In a video controller IC, graphics modes may require large amounts of memory to display information, along with long refresh times. In order to quickly process alphanumeric characters, alphanumeric modes are provided to compress the amount of data needed for each screen by providing a character set font bit map describing the pixel arrangement of each character in a character set. FIG. 2 shows how the video memory of a typical VGA controller is arranged in a alphanumeric mode.

Alphanumeric characters may be displayed in a variety of colors or various monochrome attributes. In monochrome modes, characters may be represented in low or high intensity, in reverse intensity, with underlines, or blinking. In color alphanumeric modes, one of a number (e.g., 16) of colors may be selected for the foreground, and another for the background of each character. In addition, the characters in the color mode may be commanded to blink or be underlined. In either color or monochrome mode, the one byte used for each character is called the character attribute and is stored in plane 1 of the video memory as shown in FIG. 2.

The character code may consist of a byte of data, typically an ASCII code describing the character. For example ASCII code 64 (Decimal) would represent the character "A". The character code may take one of 256 values (e.g., 00 (Hex) to FF (Hex)) in a character set, requiring eight bits (one byte) for each character. These character codes may be stored in plane 0 of the video memory as shown in FIG. 2.

The shape for each of the 512 characters, which may be generated from the character codes, may be stored as a bit map in plane 2 as shown in FIG. 2. Two or more character set font bit maps may be stored in memory. Typically, two "local" default character set font bit maps may be stored in BIOS ROM in a video controller IC. Additional "user" character set font bit maps may be loaded from RAM by a user. Two character sets may be active at one time, providing a total of 512 characters which may be displayed. Each font bit map describes the shape of each character in a pixel map, where one bit represents one pixel.

Different character sets may have different numbers of pixels per character. For example, in an EGA display, three character sets of resolutions may be provided, 8×8 pixels, 8×14 pixels (as shown in FIG. 1) and 9×14 pixels. Typical VGA displays support 8×8, 8×14, 8×16, 9×14 and 9×16 pixels characters.

Each character is represented in memory by a group of bytes, each byte typically representing a horizontal scan line. The total number of bytes may represent the overall height of the character. For example, the character shown in FIG. 1 may be stored as a bit map comprising fourteen bytes, each byte representing one scan line of the character "Z". The contents of byte 2, for example, would be FF (hex) or 11111111. The contents of byte 6 would be 18 hex, or 00011000. In most VGA/EGA controllers, 32 bytes may be reserved for each character regardless of the number of actual bytes used for the bit map of the character. Thus, a character set of 256 characters will require 8192 bytes, or 8 KB, of memory space.

Other types of bit mapping are possible. For example, some video controllers reverse the LSB and MSB. Further, for pixel resolutions greater than eight bits per scan line per character, more than one byte may be used per scan line of a character.

In the alphanumeric mode, most VGA or EGA video controller ICs do not utilize the fourth plane of the video memory, as shown in FIG. 2. This fourth plane may be used for specialized expansion modes, or, as discussed below, for mirroring the contents of plane 2 to place the character font bit maps in page mode.

As can be seen from the memory map of FIG. 2, a string of characters and character attributes may be quickly read from planes 0 and 1 (even and odd addresses). In order to access the corresponding bit maps for each character, however, a more complex memory access must be made.

For example, each character bit map may be located in plane 2 by a character shape address which may consist of a character base address plus the font character code. The byte at that address, followed by the next 13 bytes (using the 8×14 resolution example shown in FIG. 1), represent the character font bit map for one character.

However, in order for the video controller to assemble a scan line of characters, these character maps cannot be addressed sequentially. Thus, in order to draw three characters, the video controller must first retrieve the first byte of character one, the first byte of character two and then the first byte of character three in order to draw the first scan line. For the second scan line, the video controller must retrieve the second byte of character one, the second byte of character two, and the second byte of character three. This process would be repeated for all fourteen character lines (as shown in the example in FIG. 1). Thus, the video controller must randomly access the video memory to retrieve the character font bit maps. As computer speeds (clock rates) and video refresh rates have increased, this prior art technique for generating alphanumeric characters may be inadequate for high speed generation of text characters.

In prior art video controllers, individual font bit maps may be located in plane 2 of the video memory, arranged in sequential order, in 32 byte blocks. Thus, in order to access individual scan lines of a font bit map, a series of random memory accesses must be made. To fetch the ASCII and attribute bytes (which are located at sequential addresses), the memory may be accesses in page mode, which may, for example, take 50 ns for one page cycle. In order to retrieve one byte of a character fort bit map, plane 2 of the video memory must be accessed in a random cycle which may take 250 ns. Thus, the fetch time for one byte of the character font bit map may take five times as long as the page mode fetch of the ASCII character and attribute data.

One solution to this problem is to place the entire set of fonts in page mode. That is, it may be possible to write the contents of plane 2 of the video memory in to plane 3 of the video memory (or to some other memory location) and reload the fonts in a page mode into plane 2. In page mode, the fonts are arranged by scan line, rather than by ASCII character order. Thus, a first page of a character font bit map may contain 256 bytes, each byte representing the first scan line of each of the 256 characters. The second page of the character font bit map may contain 256 bytes, each byte representing the second scan line of each of the 256 characters. For a 14 line character such as shown in FIG. 1, fourteen pages of page addressable memory may be used to page fonts.

Using the paged font technique, one page access may be made to plane 2 of the video memory to retrieve all the relevant scan lines of all 256 characters, which can be assembled to produce a scan line for the video display using the ASCII and attribute information from planes 0 and 1 of the video memory.

Unfortunately, this technique suffers from at least two drawbacks. First, the technique is not VGA compatible. Since a user may load fonts into the video memory, it is possible that a conflict will arise if the user attempts to load an unpaged font into the video memory set up for paged fonts. Second, the paged font technique discussed above allows for only one font to be displayed at any given time on the screen, since in the page mode of access, all relevant scan lines of each of the 256 characters are retrieved at once.

The present invention overcomes these difficulties by providing a page mode access to allow more than one video font to be used at one time without unduly slowing down the video controller.

DISCLOSURE OF THE INVENTION

A video controller for receiving alphanumeric character data and displaying alphanumeric characters comprises a video memory for storing alphanumeric character data, character attribute data and at least two font bit maps. Each of the alphanumeric character data represents at least one character of a character set. The character attribute includes at least font selection data. The character font bit maps represent display fonts. A video font cache is provided for storing the character font bit maps in a page mode. A video memory controller, connected to the video memory and the video font cache, receives the character font bit maps from the video memory and reformats the character font bit maps into a page mode. The paged character font bit maps are stored in the font cache such that each page of the paged character font bit maps comprises one scan line for each display font of each character of the character set.

It is an object of the present invention to quickly generate alphanumeric characters for display on a video display.

It is another object of the present invention to quickly and selectively generate at least two fonts simultaneously in an alphanumeric mode on a video display.

It is a further object of the present invention to provide at least two fonts in a page mode for selective display on a video display.

BRIEF DESCRIPTION OF DRAWINGS

FIG. 4 is a font cache memory map of the present invention.

BEST MODE FOR CARRYING OUT THE INVENTION

Figure 1:
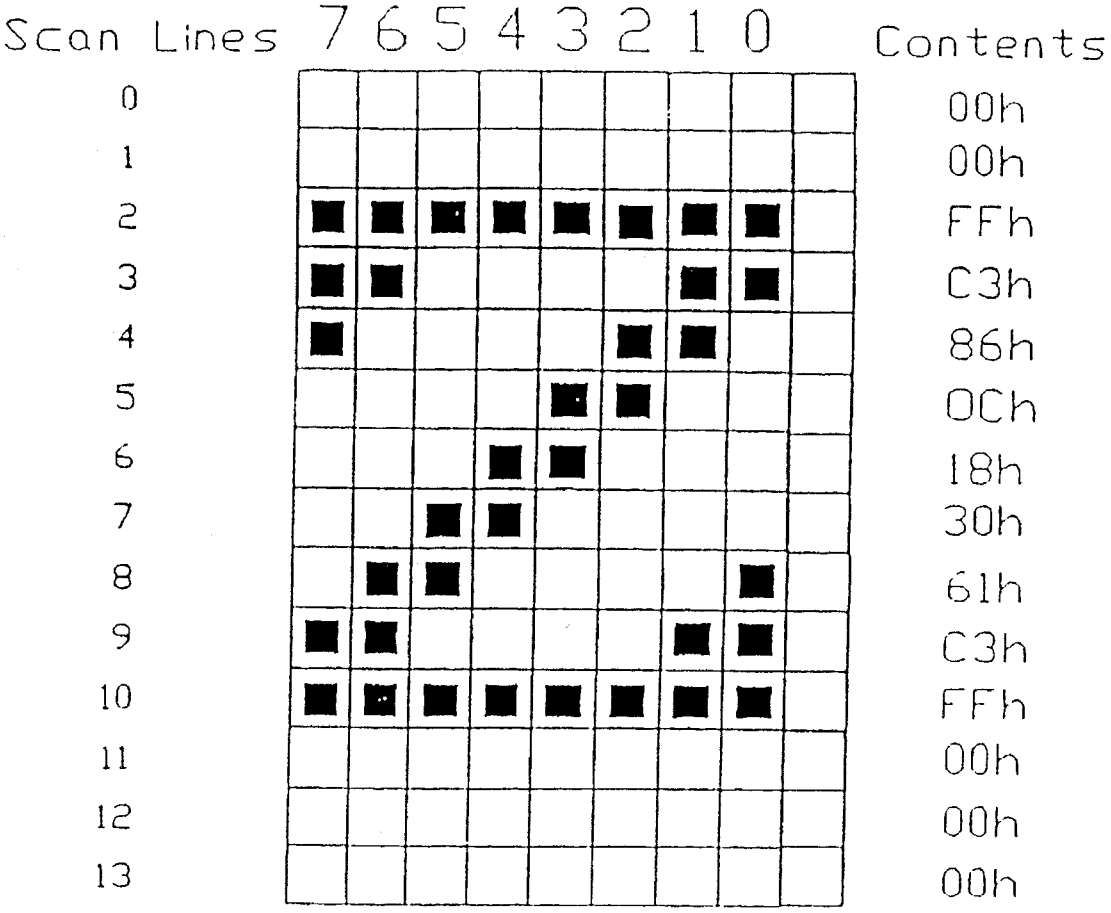
Figure 1 (Prior Art)
FIG. 1 is a Prior Art character font bit map for one character in a character set.
Figure 2:
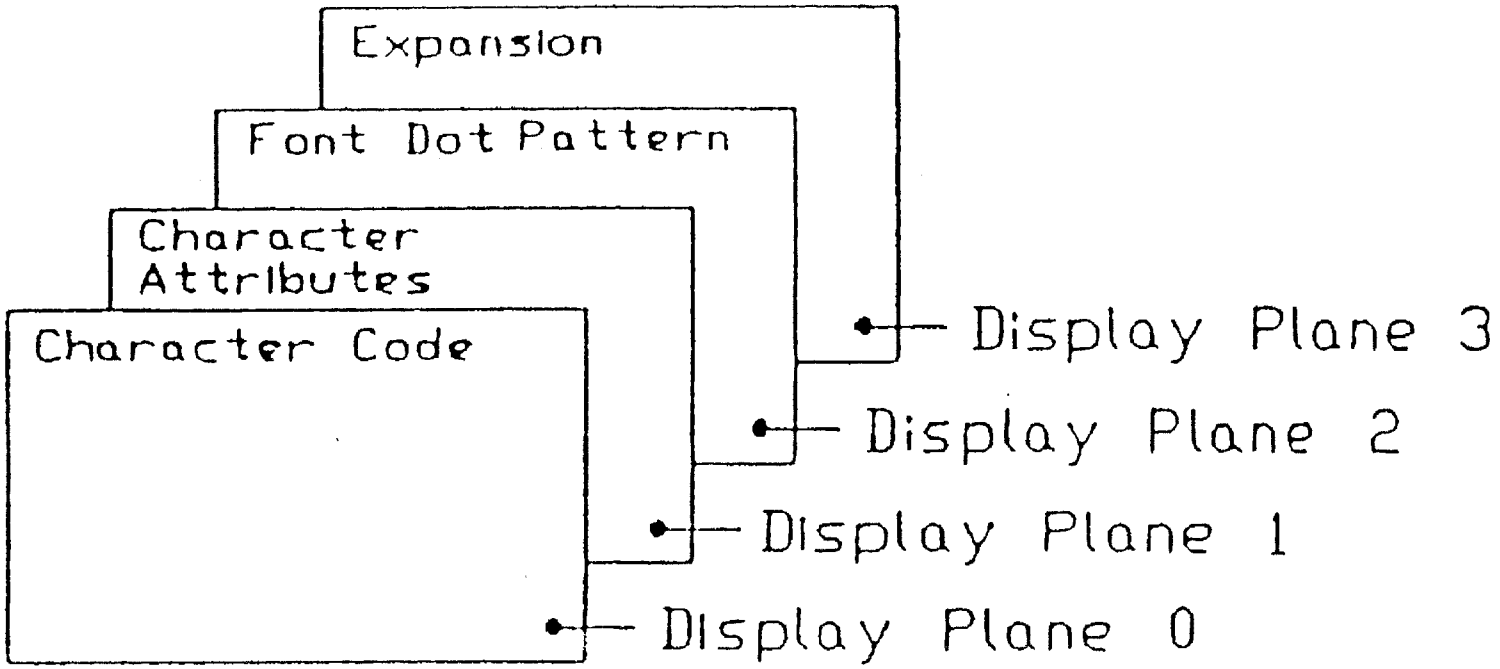
Figure 2 (Prior Art)
FIG. 2 is a Prior Art memory map for the alphanumeric mode in a video controller.
Figure 3:
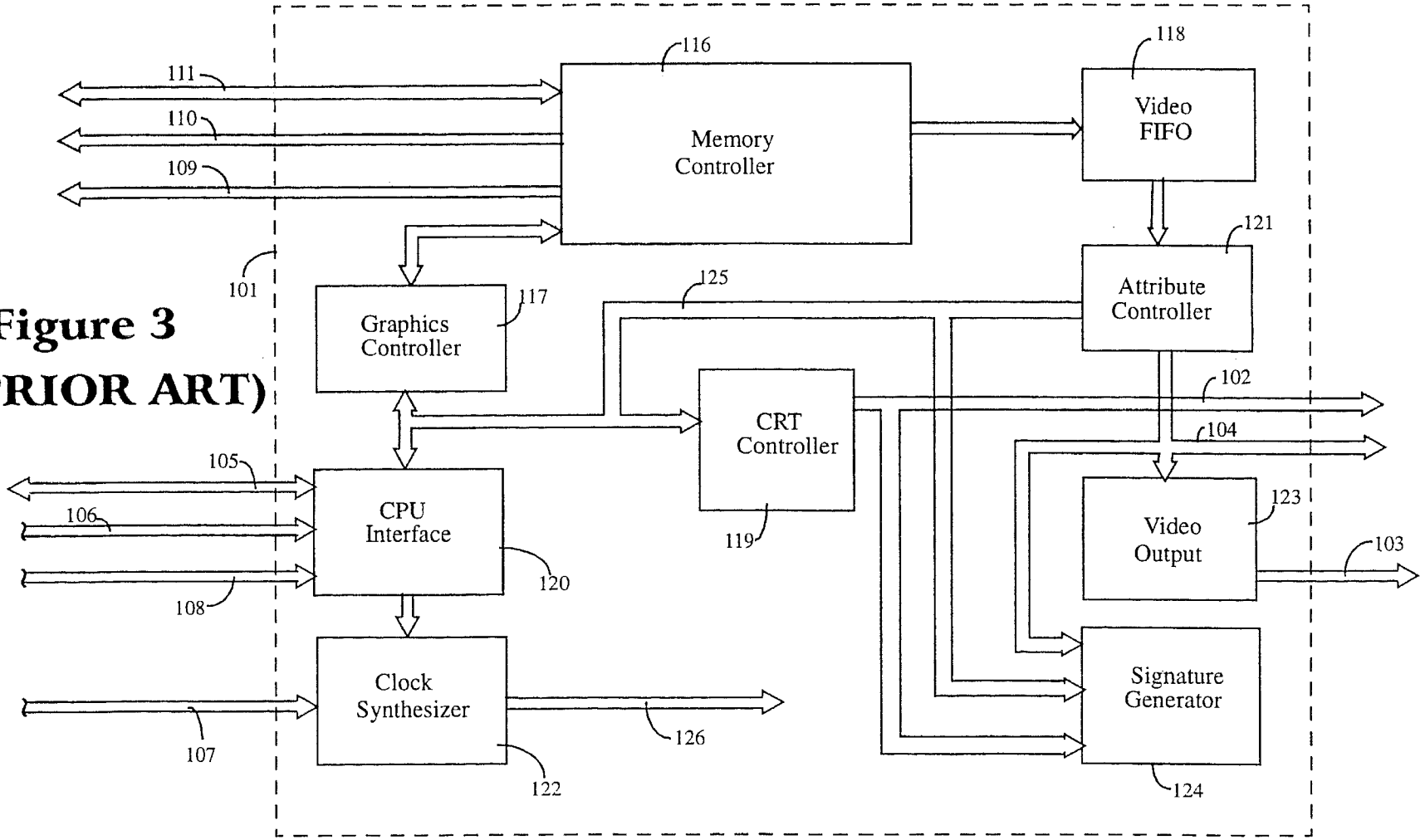
Figure 3 (PRIOR ART)
FIG. 3 is a block diagram of a video controller IC.

FIG. 4 shows a font cache memory map according to the present invention. In a typical VGA controller, such as shown in FIG. 3, a video memory may comprise a 256 KB DRAM. The four planes of video memory shown in FIG. 2 may take up less than half of the available space in 256 KB DRAM. The remaining portion of the DRAM (called "off screen" memory) may be used for other purposes. In the present invention, a portion of this off screen memory is set aside as a hidden font cache, as shown in FIG. 4. As the font cache is addressable in a page mode, the DRAM may be addressed in page mode.

In the present invention, the character font bit maps are placed in a page mode. However, in order to provide VGA compatibility and the ability to display two fonts types on one display screen, the font cache is paged using a parallel technique containing both primary and secondary fonts. Video display controllers which are VGA compatible are capable of displaying up to two fonts at a time, from any two of up to eight fonts stored in video memory. The two fonts which are active or "on-line" are called the primary and secondary fonts.

As discussed above, in many applications, a single scan line of a font bit map may comprise one byte (8 bits). Fonts with a larger number of pixels per scan line (e.g., 9) may also be represented using 8 bits by providing a hardware technique for generating the remaining ninth bit (which generally is left blank to provide space between the characters). Such a technique is discussed, for example, in *Programmer's Guide to the EGA and VGA Cards*, by Richard F. Ferraro (©1990, Addison-Wesley Publishing Company) and incorporated herein by reference. Other font bit maps may use more than one byte per scan line (e.g., 16 pixels per scan line represented by two bytes of eight bits each).

For the purposes of illustration, as shown in FIG. 4, both primary and secondary fonts have eight pixels per scan line, or one byte per scan line. In this embodiment, a memory having a width of 16 bits (i.e., one word or two bytes) is used. At each memory address, two bytes are stored, each bytes representing a scan line of a character font bit map. Both fonts have been paged in a parallel fashion. Thus, for example, at memory address 3BFFF, the 32nd scan line (i.e., scan line 1F (hex)) for both primary and secondary fonts for the 256th ASCII character in a character set (i.e., ASCII=FF(hex)) are stored. At the next sequential address, the 32nd scan line (i.e., scan line 1F (hex)) for both primary and secondary fonts for the 255th ASCII character in a character set (i.e., ASCII=FE(hex)) are stored. Thus, the first page of the font cache memory contains the 32nd scan lines for all 256 characters in a character set in both primary and secondary fonts.

The remaining 31 pages of the font cache memory are arranged in a similar manner, each providing a scan line byte for all 256 characters in a character set for both primary and secondary fonts. Of course, as shown here, the last line (i.e., scan line 1F) is shown at the highest memory address. Other orderings may be used. For example, the first scan line (i.e., scan line 00) may be stored at the highest memory address. Similarly, the ordering of the ASCII character set may also be reversed or reordered.

When generating alphanumeric characters for display on a display screen (e.g., CRT, flat panel display or the like), a video controller may fetch one page of the font cache memory in page mode corresponding to the scan line to be scanned to the video display. Since the font bytes are fetched in the page mode, the need for a series of random accesses of the font memory is reduced or eliminated. For the ASCII character byte stored in plane 0 of the video memory, the controller can obtain the correct scan line word (i.e., two bytes, each representing a different font) from the retrieved page of font cache memory. The character attribute byte, retrieved from plane 1 at the same time as the ASCII character byte may indicate which font is to be used (primary or secondary) as well as other character attributes (e.g., foreground, background, underline, reverse video, flash). Since the video controller has retrieved the font character bit map scan line bytes for both fonts, the controller can select from either font for simultaneous display on a video display.

In the example shown here, only two fonts may be displayed simultaneously in alphanumeric mode, which is a typical requirement for the VGA standard. These two fonts may be selected from one of eight resident fonts, either provided from VGA BIOS or loaded by a user. To select another font, that font would be placed in page mode and put into the font cache memory in the form shown in FIG. 4.

Of course, with other memory widths, other features are possible. For example, a memory width of 32 bits (4 bytes) is used, two fonts may be loaded in page mode, each having 16 bits (2 bytes) per scan line. Alternatively, for a 32 bit wide memory, four fonts, each having eight bits per scan line, may be loaded and "on line". In such an embodiment, up to four fonts may be displayed at one time in alphanumeric mode on a display screen. Other scan line widths, numbers of fonts, and memory widths may be used without departing from the spirit or scope of the invention.

Figure 5:
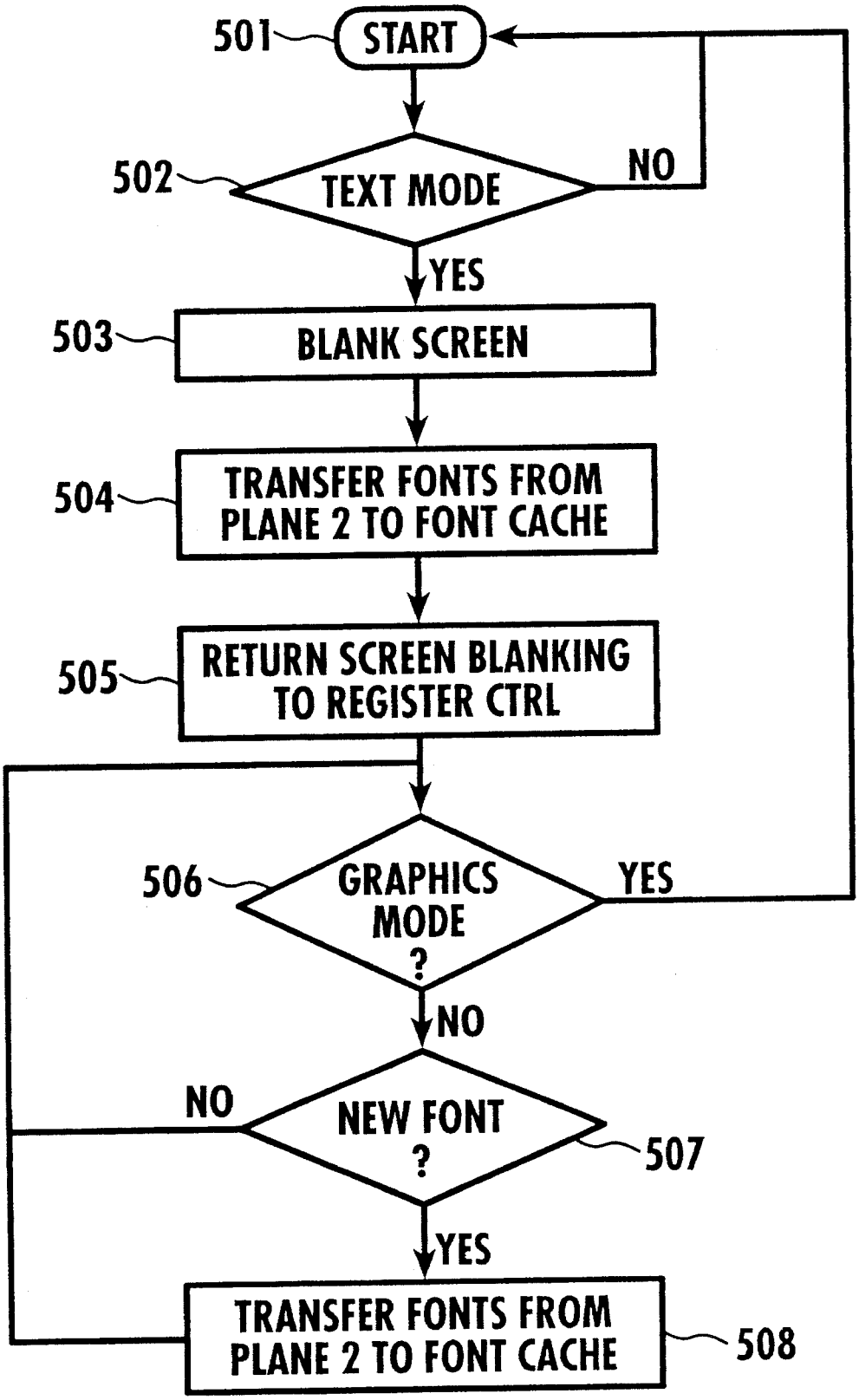
FIG. 5 is a flow chart showing the operation of the present invention.

FIG. 5 show the process for operating the video font cache of the present invention. Such a process may be achieved using the video controller IC shown in FIG. 3 with suitable modifications to provide necessary interrupts and memory transfer operations as discussed below. Steps 501 and 502 represent a monitoring step performed by the video controller IC to monitor the state of the video memory to determine whether a text mode (alphanumeric mode) has been entered. As planes 0 and 1 of the video memory represent even and odd sequential addresses, they are often read simultaneously, as discussed in Ferraro, above. The memory controller portion of a video controller IC detects this event by determining whether planes 0 and 1 of the video memory have been selected while plane 2 is de-selected. Once this condition is detected, entry into text or alphanumeric mode is detected and processing passes to step 503.

In step 503, the screen is blanked. Next, in step 504, the video controller IC will select the two fonts (primary and secondary) from plane 2 of video memory pointed at by a font select register and transfer these two fonts into the video font cache, while simultaneously translating the two fonts into page mode as shown in FIG. 4. The font select register in the video controller IC contains data indicating which fonts have been selected by the user (e.g., software). When the font transfer is complete, as shown in step 505, the internal screen blanking will be removed without affecting any possible register controlled screen blanking. In the case that the screen is still blanked by a register bit, the screen will remain blanked until the register bit is written to by software. During the font transfer, CPU and memory refresh cycles are executed, but CRT and flat panel cycles are suppressed, as the screen blanking suppresses FIFO read cycles.

Once the primary and secondary fonts have been loaded and paginated into the font cache, the video controller will access the fonts in page mode as discussed above, rather than using the prior art technique of using a series of random memory accesses for particular font bytes. In steps 506 and 507, the video controller IC monitors the video memory for two conditions. In step 506, the video controller IC detects whether a graphics mode has been selected. Graphics modes can easily be detected by the memory controller portion of the video controller IC by monitoring whether all four bit planes of the video memory have been enabled simultaneously. If a graphics mode is selected, processing passes to step 501.

In step 507, the video controller IC detects whether a user (e.g., software) has attempted to load a new font. Font changes are detected by the video controller IC, in an EGA or VGA application by monitoring one of the five sequencer registers within the video controller IC. These sequencer registers are discussed in chapter 10.3 of Ferraro, cited above, and consist of one address register and five data registers which are used by the video controller to set or indicate various states of the controller. These registers may be read to or written from by an external host processor in order to control aspects of the video controller IC.

The third of these sequencer registers, the character map select register, discussed in chapter 10.3.4 of Ferraro, indicates which one of two character sets has been selected. In the present invention, the video controller IC monitors this register to determine whether a font change has been initiated. The register may comprise 8 bits. Bits 0 and 1 comprise data field SB, while bits 2 and 3 comprise data field SA. Bit 4 represents the high bit of the SB field whereas bit 5 represents the high bit of the SA field. If fields SB and SA have different values, the video controller IC assumes that bit 3 should be used to select the character set. The video controller IC monitors the character map select register to determine whether a change has occurred in field SB and bit 4 or a change in field SA and bit 5. If such a change occurs, the video controller IC determines that a font select change has occurred.

If a user attempts to load a new font, the video controller IC will select plane 2 to load the new font into one of the eight portions (for VGA) of plane 2 available for character font bit maps. The video controller IC will allow an external CPU to make the standard CPU cycle to plane 2 of the video memory as shown in step 508, and then, through an internally generated cycle, transfer and translate the same data to the corresponding addresses in the font cache. In the preferred embodiment, the video controller IC will translate and reload both fonts into the font cache in page mode, even if only one of these fonts has been changed. Thus, the font cache is updated with any new fonts selected by a user or by software. Once the fonts have been updated, processing passes to step 506.

Thus, the video controller continuously monitors the video memory and updates the fonts as necessary. Since the fonts are in page mode, random memory access is eliminated or reduced in number, and refresh rate can be increased. Since two fonts are paged in a parallel technique, two fonts may be displayed at one time on the video display, and the resulting video controller may be compatible with the VGA format.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

We claim:

1. A video controller for receiving alphanumeric character data and generating alphanumeric characters for a video display said video controller comprising:

a video memory for storing alphanumeric character data, each of said alphanumeric character data representing at least one character of a character set, character attribute data including at least font selection data, and at least two character font bit maps, each of said at least two character font bit maps representing a display font;

a video font cache for storing said at least two character font bit maps in a page mode; and a video memory controller, coupled to said video memory and said video font cache, for receiving said at least two character font bit maps from said video memory and reformatting said at least two character font bit maps in said font cache;

wherein each page of said paged character font bit maps comprises one scan line for each display font of each character of said character set.

2. The video controller of claim 1, wherein said memory controller receives at least one of said alphanumeric character data and corresponding attribute data and retrieves a scan line corresponding to both said at least one alphanumeric character data and a display font selected by font selection data in said attribute data.

3. A method of generating alphanumeric characters in a video controller comprising the steps of:

retrieving at least two character font bit maps, each representing a character font, from a video memory, each of said character font bit maps comprising a scan line bit map for each character of a character set; and reformatting said character font bit maps into a page mode to produce paged character font bit maps such that each page of said paged character font bit maps comprises one scan line for each character of a character set in each character font.

4. The method of claim 3, further comprising the steps of:

retrieving at least one character datum representing one character of a character set;

retrieving at least one attribute datum corresponding to said at least one character datum, said at least one attribute datum including at least font selection data;

retrieving in page mode, one page of said paged character font bit map;

retrieving at least two scan lines corresponding to said at least one character datum from said retrieved one page of said paged character font bit map, each of said at least two scan lines corresponding to said at least two character fonts; and selecting, from said retrieved at least one attribute datum, one scan line from said retrieved at least two scan lines.

5. The method of claim 4, further comprising the steps of:

scanning said selected one scan line onto a video display.

6. The method of claim 4, wherein said at least one character datum comprises eight bits of ASCII data.

7. The method of claim 4, wherein said at least one attribute datum comprises eight bits of data indicating at least font selection, foreground color, background color, underlining, and blinking of a corresponding character.

8. The method of claim 3, wherein each scan line bit map is comprised of a plurality of bytes, each byte comprising eight bits of pixel data representing one scan line of a character font on a video display.

9. The method of claim 3, further comprising the steps of:

monitoring said video memory for a change in either of said at least two character font bit maps;

reformatting, in response to a detected change in either of said at least two character font bit maps, said character font bit maps into a page mode to produce paged character font bit maps such that each page of said paged character font bit maps comprises one scan line for each character of a character set in each character font.

10. The method of claim 9, wherein said video memory is arranged into at least three bit planes and wherein said at least one character datum is stored in a first plane, said at least one attribute data is stored in a second plane, and said at least two character font bit maps are stored in a third plane.

11. The method of claim 10, wherein said step of monitoring comprises the step of monitoring said video memory to detect de-selection of said first and second planes of said video memory and selection of said third plane of video memory to detect a change in either of said at least two character font bit maps.

12. The method of claim 10, further comprising the preliminary steps of:

monitoring said video memory to determine whether said video controller is in an alphanumeric mode.

13. The method of claim 12, wherein said step of monitoring further comprises the steps of monitoring said video memory to detect selection of said first and second planes of said video memory and de-selection of said third plane of video memory to detect a change in either of said at least two character font bit maps.

14. The method of claim 3, wherein said paged character font bit maps comprise a number of pages of font data, each page of said paged font data corresponding to one scan line of each character of a character set; each page further comprising a number of words equal to the number of characters in the character set, each word comprising a number of bytes corresponding to the number of at least two fonts, each byte representing pixel data from one scan line of a character.

15. The method of claim 14, wherein each byte comprises eight bits, each bit representing pixel data for a scan line on a video display.

16. An apparatus for storing, generating and displaying alphanumeric characters comprising:

a processor for generating alphanumeric character data, each of said alphanumeric character data representing one character of a character set, attribute data including at least font selection data corresponding to each of said alphanumeric character data; and font data representing pixel data for a font for each alphanumeric character;

a video controller, coupled to said processor, for receiving said alphanumeric character data, said attribute data, and said font data and storing said alphanumeric data, attribute data and font data in a video memory and converting said font data into a page mode to produce paged font data; and a font cache, coupled to said video controller, for receiving and storing said font data in a page mode such that each page of said paged font data comprises pixel data for one scan line for each character in a character set.

17. The apparatus of claim 16, wherein said video controller further comprises:

character generating means, coupled to said video memory and said font cache, for retrieving said character data and at least one page of said font cache and generating a scan line of pixel data from said at least one page of said font cache, said scan line of pixel data representing a scan line of characters corresponding to said retrieved character data.

18. The apparatus of claim 17, further comprising:

video display means, coupled to said video controller, for receiving said scan line of pixel data and generating a video image from said scan line of pixel data.

19. The apparatus of claim 16, wherein said video controller further comprises:

read only memory means, for storing default font data, wherein said video controller transfers said default font data to said video memory.

20. A video controller for receiving alphanumeric character data and generating alphanumeric characters of a video display, said video controller comprising:

a video memory, comprising:

a first memory plane for storing alphanumeric character data, each of said alphanumeric character data representing at least one character of a character set, a second memory plane for storing character attribute data including at least font selection data, a third memory plane for storing at least two character font bit maps, each of said at least two character font bit maps representing a display font, and a video font cache for storing said at least two character font bit maps in a page mode; and a video memory controller, coupled to said video memory, for receiving said at least two character font bit maps from said video memory and reformatting said at least two character font bit maps into a page mode to produce paged character font bit maps and storing said paged character font bit maps in said font cache;

wherein each page of said paged character font bit maps comprises one scan line for each display font of each character of each character set, and said at least two character font bit maps are stored in said third memory plane by an external host processor in an unpaged mode.

21. A method of displaying an alphanumeric character in a predetermined format on a display system comprising a plurality of scan lines, each scan line comprising a plurality of pixels, wherein a bit map corresponding to at least first and second fonts of the alphanumeric character is stored in a first memory such that the pixels corresponding to the first font are stored followed by pixels corresponding to the second font, the two fonts including the predetermined font; the method comprising the steps of:

rearranging the pixels by storing the pixels corresponding to the at least first and second fonts in a second memory such that pixels corresponding to one scan line of the at least first and second fonts are stored before pixels corresponding to a next scan line of the at least first and second fonts;

retrieving a plurality of sequential pixels from the second memory such that pixels of at least one scan line corresponding to both the fonts are included in the retrieved pixels;

selecting pixels corresponding to a predetermined font of the two fonts; and displaying a scan line in the predetermined font by displaying the selected pixels.

* * * * *